US007443357B2

(12) United States Patent
Mei

(10) Patent No.: US 7,443,357 B2
(45) Date of Patent: Oct. 28, 2008

(54) PLANAR INVERTED-F ANTENNA

(75) Inventor: Chia-Hao Mei, Tu-Cheng (TW)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 212 days.

(21) Appl. No.: 11/237,218

(22) Filed: Sep. 28, 2005

(65) Prior Publication Data

US 2006/0145925 A1 Jul. 6, 2006

(30) Foreign Application Priority Data

Jan. 6, 2005 (CN) ..... 2005 2 0053550 U

(51) Int. Cl.
*H01Q 21/20* (2006.01)

(52) U.S. Cl. ..... 343/800; 343/795; 343/700 MS

(58) Field of Classification Search ..... 343/700 MS, 343/702, 895, 795, 745, 800
See application file for complete search history.

(56) References Cited

U.S. PATENT DOCUMENTS 6,342,859 B1 * 1/2002 Kurz et al. ..... 343/702
6,404,394 B1 * 6/2002 Hill ..... 343/702
6,781,547 B2 * 8/2004 Lee ..... 343/700 MS
6,995,710 B2 * 2/2006 Sugimoto et al. ..... 343/700 MS
7,116,274 B2 * 10/2006 Huang et al. ..... 343/700 MS
7,183,976 B2 * 2/2007 Wu et al. ..... 343/700 MS
2004/0145527 A1 * 7/2004 Mikkola ..... 343/700 MS
2004/0201532 A1 * 10/2004 Apostolos et al. ..... 343/742
2005/0110684 A1 * 5/2005 Liu ..... 343/700 MS
2005/0280579 A1 * 12/2005 Liang et al. ..... 343/700 MS

* cited by examiner

*Primary Examiner*—Huedung Mancuso
(74) *Attorney, Agent, or Firm*—Andrew C. Cheng

(57) ABSTRACT

A planar inverted-F antenna includes a body (300), a feed wire (400), a shorting strip (500), and a metallic ground plane (200). The body is used for radiating and receiving radio frequency signals, and includes a radiating end (310) and a shorting end (320). The shorting end is electrically connected to a metallic ground plane by the shorting strip. The feed wire is electrically connected to the body. The body includes bent portions (330, 340) disposed between the shorting end and the radiating end. Due to the bent portions, the planar inverted-F antenna has a compact profile and a smaller size. In addition, the bent portions generate an inductance effect that can regulate the input impedance of the planar inverted-F antenna.

18 Claims, 3 Drawing Sheets

PLANAR INVERTED-F ANTENNA

BACKGROUND

1. Field of the Invention

The present invention relates to antennas, and particularly to planar inverted-F antennas for wireless communication devices.

2. Related Art

Wireless communication devices, such as mobile phones, wireless cards, and access points, wirelessly radiate signals by use of electromagnetic waves. Thus, remote wireless communication devices can receive the signals without the need for cables.

In a wireless communication device, the antenna is a key element for radiating and receiving radio frequency signals. Characteristics of the antenna, such as radiation efficiency, orientation, frequency band, and impedance match, have a significant influence on performance of the wireless communication device. Nowadays, there are two kinds of antennas: built-in antennas and external antennas. In contrast to the external antenna, the size of the built-in antenna is smaller, and the body of the built-in antenna is protected and not easily damaged. Thus, the built-in antenna is commonly employed in wireless communication devices. Common built-in antennas include low temperature co-fired ceramic antennas and printed antennas. The low temperature co-fired ceramic (LTCC) antenna has good performance in high frequencies and at high temperatures, but is expensive. A common type of printed antenna is the planar inverted-F antenna. Compared to low temperature co-fired ceramic antennas, planar inverted-F antennas are small, light, thin, and inexpensive. Accordingly, planar inverted-F antennas are being used more and more in wireless communication devices.

In general, the planar inverted-F antenna is a printed circuit disposed on a substrate, and is used for radiating and receiving radio frequency signals. FIG. 3 is a schematic diagram of a typical planar inverted-F antenna. The planar inverted-F antenna includes a body 30, a feed wire 40, a shorting strip 50, and a metallic ground plane 20. The body 30 is used for radiating and receiving radio frequency signals, and includes a radiating end 31 and a shorting end 32. The shorting end 32 of the body 30 is connected to the metallic ground plane 20 by the shorting strip 50. The metallic ground plane 20 includes an opening 60. The feed wire 40 is electrically connected to the body 30, and is parallel to the shorting strip 50. The feed wire 40 is also electrically connected to a matching circuit (not shown) through the opening 60, for generating a matching impedance. The feed wire 40 is isolated from the metallic ground plane 20. The metallic ground plane 20, the body 30, the feed wire 40, and the shorting strip 50 are printed on the substrate 10.

In recent years, more attention has been paid to developing small-sized and low-profile wireless communication devices. Antennas, as key elements of wireless communication devices, have to be miniaturized accordingly. Although, the above-described planar inverted-F antenna is smaller than an external antenna, the profile of the above-described planar inverted-F antenna cannot be reduced efficiently, and so the profile of the corresponding wireless communication device cannot be reduced efficiently. Besides, requirements to the performance of the above-described planar inverted-F antenna have become higher and more rigorous. Therefore, what is needed is a planar inverted-F antenna with a compact profile and better performance.

SUMMARY

Embodiments of the invention provide a planar inverted-F antenna with a compact profile comprising a body, a feed wire, and a shorting strip. The body for radiating and receiving radio frequency signals, comprises a radiating end, a shorting end, and at least one bent portion, disposed between the radiating end and the shorting end. The feed wire is electrically connected to the body; and a shorting strip with one end electrically connected to the shorting end of the body, and the other end being grounded.

The direct distance between the radiating end and the shorting end of the planar inverted-F antenna is reduced due to the bent portion. Thus, the planar inverted-F antenna has a compact profile and a smaller size. In addition, the bent portion generates an inductance effect that can regulate the input impedance of the antenna.

Other advantages and novel features will be drawn from the following detailed description of preferred embodiments with the attached drawings, in which:

DETAILED DESCRIPTION OF THE EMBODIMENTS

Figure 1:
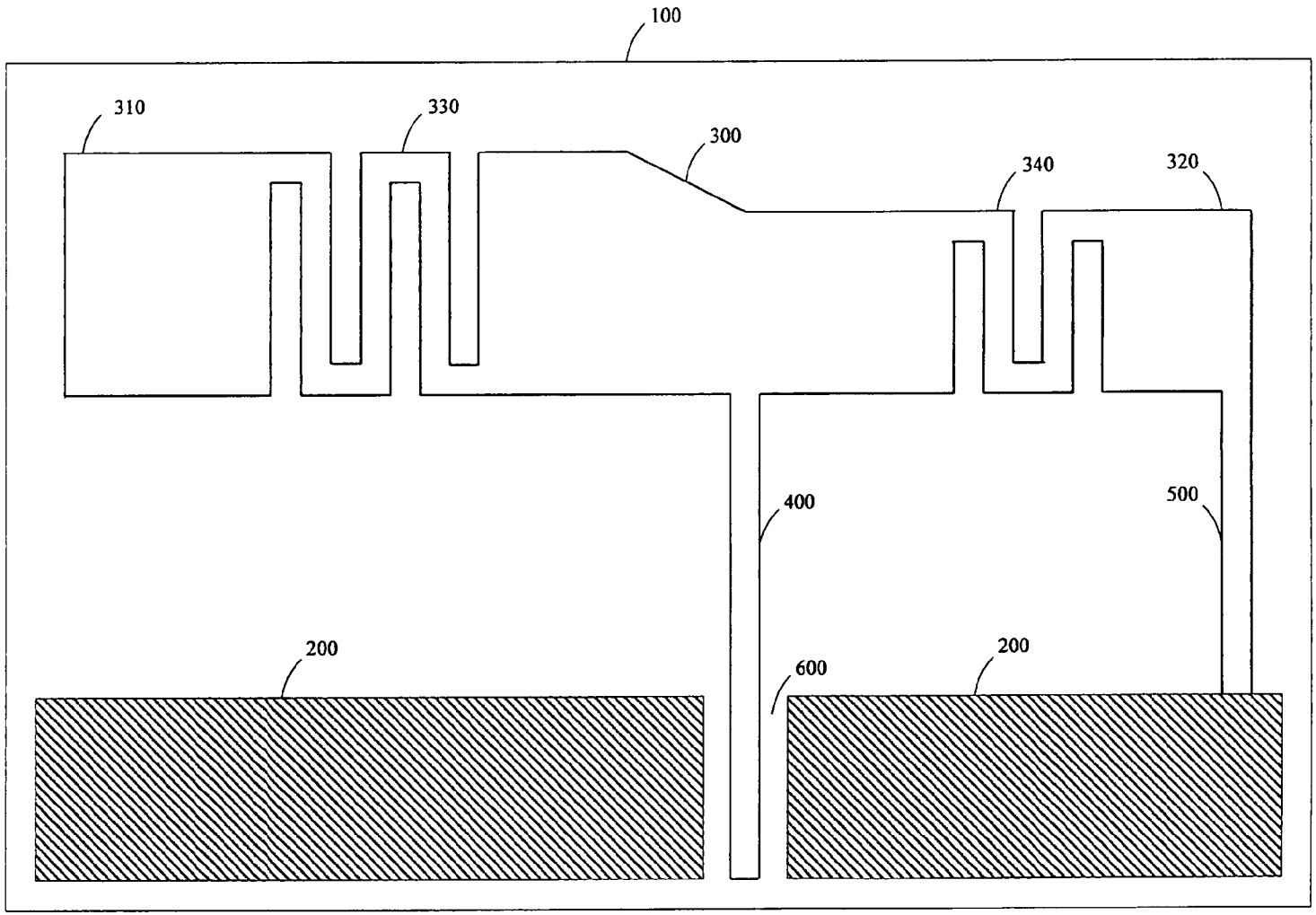
FIG. 1 is a schematic plan view of a planar inverted-F antenna according to a preferred embodiment of the present invention.

FIG. 1 is a schematic diagram of a planar inverted-F antenna of an embodiment of the present invention. The planar inverted-F antenna includes a body 300, a feed wire 400, a shorting strip 500, and a metallic ground plane 200. The metallic ground plane 200 includes an opening 600. The body 300 is used for radiating and receiving radio frequency signals, and includes a radiating end 310 and a shorting end 320. The shorting end 320 is electrically connected to the metallic ground plane 200 via the shorting strip 500. The feed wire 400 is electrically connected to the body 300. In the embodiment, the feed wire 400 is parallel to the shorting strip 500. The feed wire 400 is electrically connected to a matching circuit (not shown) through the opening 600. In an alternative embodiment, there is no matching circuit connected to the feed wire 400. The feed wire 400 is isolated from the metallic ground plane 200. In the embodiment, a width of a portion of the body 300 between the feed wire 400 and the shorting end 320 is less than that of the other portion of the body 300 between the feed wire 400 and the radiating end 310. In an alternative embodiment, the width of a portion of the body 300 between the feed wire 400 and the shorting end 320 is equal to or greater than the width of the other portion of the body 300 between the feed wire 400 and the radiating end 310. The metallic ground plane 200, the body 300, the feed wire 400, and the shorting strip 500 are printed on the substrate 100.

In the embodiment, the body 300 further comprises at least one meandrously bent portion 330 or 340, disposed between the radiating end 310 and the shorting end 320. Each bent portion 330 or 340 has two or more meandrously overlapping sub-portions. In this embodiment, the body 300 comprises two bent portions 330 and 340. The bent portions 330 and 340 are substantially parallel to the metallic ground plane 200. The bent portion 330 is disposed between the radiating end 310 and the feed wire 400, and the bent portion 340 is disposed between the shorting end 320 and the feed wire 400. In the embodiment, the bent portions 330 and 340 are both angular; i.e., sharp-cornered. In alternative embodiments, either or both of the bent portions 330 and 340 may be curved, or a combination of angular portions and curved portions. In other alternative embodiments, the body 300 may include only one bent portion, or more than two bent portions. In further alternative embodiments, the number of overlapping portions of each of the bent portions 330 and 340 can be varied.

With the above-described configuration, the rectilinear length of the body 300 between the radiating end 310 and the shorting end 320 is reduced due to the meandrously bent portions 330 and 340. Thus, the planar inverted-F antenna has a lower profile and a smaller size. In addition, the bent portions 330 and 340 generate an inductance effect and thus regulate the input impedance of the planar inverted-F antenna.

Figure 2:
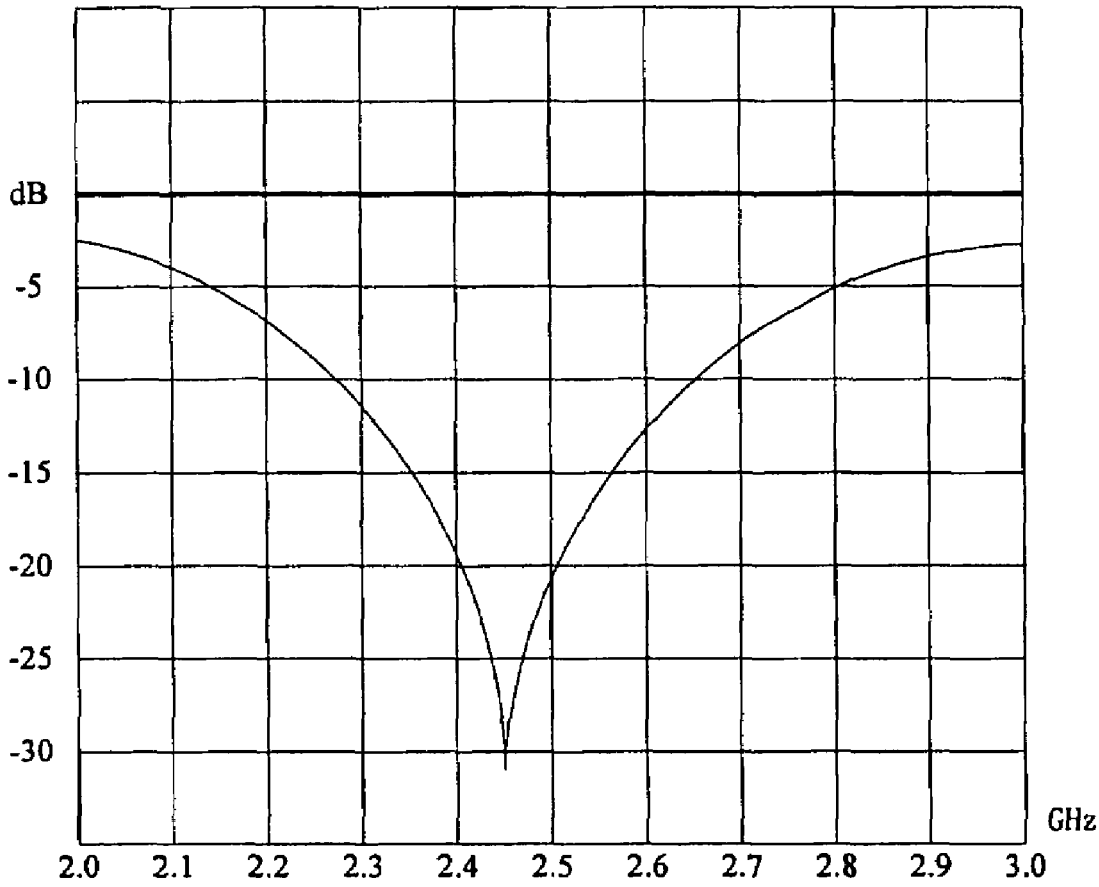
FIG. 2 is a test chart showing return loss of the planar inverted-F antenna of FIG. 1.
Figure 3:
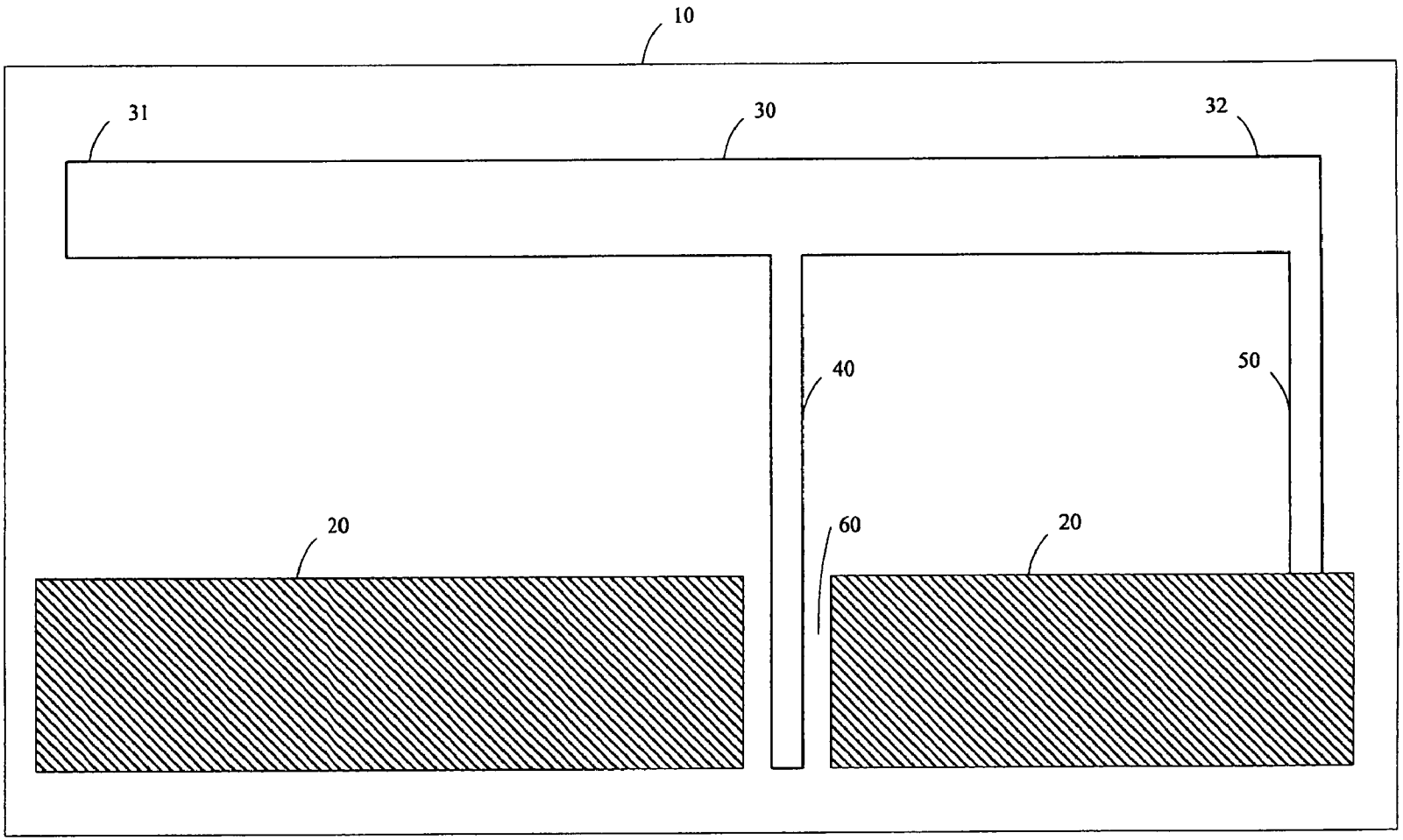
FIG. 3 (RELATED ART)
FIG. 3 is a schematic plan view of a conventional planar inverted-F antenna.

FIG. 2 is a test chart showing return loss of the planar inverted-F antenna when used in a wireless communication device, with the return loss as its vertical coordinate thereof and the frequency as its horizontal coordinate. When the planar inverted-F antenna operates in frequency bands of 2.4~2.5 GHz, return loss drops below −20 dB, which can satisfactorily meet normal practical requirements.

It is to be understood, however, that even though numerous characteristics and advantages of the embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. A planar inverted-F antenna, comprising:

a body printed on a substrate, for radiating and receiving radio frequency signals, the body comprising a radiating end, a shorting end, and a bent portion for reducing a profile of the planar inverter-F antenna and generating an inductance effect to regulate an input impedance of the planar inverter-F antenna;

a feed wire electrically connected to the body; and a shorting strip with one end electrically connected to the shorting end of the body, and the other end being grounded;

wherein the bent portion is disposed between the feed wire and the shorting end.

2. The planar inverted-F antenna as recited in claim 1, further comprising a metallic ground plane.

3. The planar inverted-F antenna as recited in claim 2, wherein the feed wire is isolated from the metallic ground plan.

4. The planar inverted-F antenna as recited in claim 2, wherein the shorting strip is electrically connected to the metallic ground plane.

5. The planar inverted-F antenna as recited in claim 2, wherein the bent portion is substantially parallel to the metallic ground plane.

6. The planar inverted-F antenna as recited in claim 1, wherein the bent portion has two or more overlapping portions.

7. The planar inverted-F antenna as recited in claim 1, further comprising another bent portion, disposed between the radiating end and the feed wire.

8. The planar inverted-F antenna as recited in claim 1, wherein the bent portion is angular.

9. The planar inverted-F antenna as recited in claim 1, wherein the bent portion is curved.

10. The planar inverted-F antenna as recited in claim 1, wherein the bent portion comprises two bent portions, having a combination of an angular portion and a curved portion.

11. The planar inverted-F antenna as recited in claim 1, wherein the bent portion occupies an area of the body having a width same as a width of the shorting end, and the area is flush with the shorting end.

12. An antenna comprising:

a body of said antenna printed on a substrate, extending along a predetermined direction with a predetermined length, and defining one end thereof to radiate signals and the other end thereof being grounded, at least one portion of said body extending along said predetermined direction for a length less than said predetermined length, said at least one portion of said body comprising more than one sub-portion distributed therein and significantly thinner than other portions of said body; and a feeding wire electrically connecting with said body to collect said signals;

wherein said at least one portion of said body is disposed between said other end of said body and said feeding wire for reducing a profile of said antenna and generating an inductance effect to regulate an input impedance of said antenna.

13. The antenna as recited in claim 12, wherein each of said more than one sub-portion of said at least one portion of said body of said antenna extends along another direction different from said predetermined direction of said body.

14. The antenna as recited in claim 12, wherein said more than one sub-portion of said at least one portion of said body of said antenna is meandrously distributed within said at least one portion of said body.

15. The antenna as recited in claim 12, wherein said at least one portion of said body occupies an area of said body having a width same as a width of said other end of said body, and said area is flush with said other end of said body along said predetermined direction.

16. A method to manufacture an antenna, comprising the steps of:

preparing a substrate;

printing a body of an antenna onto said substrate by characterizing said body as an electrically conductive extension between a radiating end thereof and a ground end thereof along a predetermined direction with a predetermined length;

electrically connecting said body with a feeding wire for signal collection and a ground plane for being grounded at said ground end; and forming at least one portion of said body disposed between said feeding wire and said ground end and having a length thereof less than said predetermined length to define more than one sub-portion therein continuously extending along another direction different from said predetermined direction to reduce a profile of said antenna and generate an inductance effect to regulate an input impedance of said antenna.

17. The method as recited in claim 16, wherein said more than one sub-portion of said at least one portion of said body of said antenna is meandrously distributed within said at least one portion of said body.

18. The method as recited in claim 16, wherein said at least one portion of said body occupies an area of said body having a width same as a width of said ground end, and said area is flush with said ground end along said predetermined direction.

* * * * *